US005348368A

United States Patent [19]

Garcia et al.

[11] Patent Number: 5,348,368

[45] Date of Patent: Sep. 20, 1994

[54] SHIELD FOR HIGH CHAIR

[76] Inventors: Brent E. Garcia; Mary L. Garcia; John A. Garcia, all of 5107 Dufferin St., Arlington, Tex. 76016

[21] Appl. No.: 380

[22] Filed: Jan. 4, 1993

[51] Int. Cl.[5] ..... A47B 83/02

[52] U.S. Cl. ..... 297/148; 297/184.13; 160/352

[58] Field of Search ..... 297/148, 184, 217, 149, 297/150, 487, DIG. 6, 184.1, 184.11, 184.13, 184.14, 184.12; 160/135, 351, 352

[56] References Cited

U.S. PATENT DOCUMENTS

| | | | |
|---|---|---|---|
| 1,098,218 | 5/1914 | Boileau | 160/352 X |
| 2,582,373 | 1/1952 | Cordrey | 160/352 X |
| 2,679,288 | 5/1954 | Larger | 297/217 X |
| 3,330,597 | 7/1967 | Lay et al. | 297/148 |
| 3,538,976 | 11/1970 | Gilbert | 160/351 X |
| 3,848,921 | 11/1974 | Rhodes | 297/184 |
| 4,030,748 | 6/1977 | Brock | 297/184 |
| 4,100,633 | 7/1978 | Pintos | 297/184 X |
| 4,131,312 | 12/1978 | Price | 297/184 |
| 4,360,053 | 11/1982 | Buckner | 160/352 |
| 4,449,763 | 5/1984 | Barnett | 160/352 X |
| 4,579,385 | 4/1986 | Koenig | 297/184 |
| 4,597,698 | 7/1986 | Liebetrau | 160/352 X |
| 4,759,520 | 7/1988 | Levine | 160/135 X |
| 4,865,111 | 9/1989 | Perutz | 160/352 X |
| 4,923,249 | 5/1990 | Mattox | 297/184 |
| 5,007,674 | 4/1991 | Franc | 297/184 |
| 5,074,616 | 12/1991 | Smith | 297/184 |

*Primary Examiner*—Kenneth J. Dorner
*Assistant Examiner*—Milton Nelson, Jr.
*Attorney, Agent, or Firm*—Geoffrey A. Mantooth

[57] ABSTRACT

A shield is disclosed which attaches to a high chair tray for the purpose of preventing the high chair occupant from displacing food over the front and sides of the high chair tray. The shield has a wall which partially encompasses the eating surface of the high chair tray, around the edges of the tray. The wall serves to block disposal of food over the front and sides of the tray. The shield also has fasteners which allow the wall to be removably coupled to the high chair tray and which prevents the shield from being easily dislodged from the tray.

10 Claims, 2 Drawing Sheets

SHIELD FOR HIGH CHAIR

FIELD OF THE INVENTION

The present invention relates to accessory devices for high chairs of the type used for seating infants and young children.

BACKGROUND OF THE INVENTION

High chairs are commonly used to seat infants and young children during meals. High chairs have a seat for the infant or young child, and have a tray upon which the child's meal is placed. The tray is securely coupled to the frame of the chair.

Young children often tend to be messy eaters. In addition to getting food all over themselves, their bibs and cloths, they throw and knock food off the high chair tray. The food that is displaced from the high chair tray lands on the floor and other nearby objects such as furniture, rugs, etc. The floor and other nearby objects must then be cleaned up, which creates extra work for the child's parents. Baby foods in thin paste form in particular seem to be susceptible of being displaced from the tray and onto surrounding objects. These same pasty foods are difficult to clean up. Occasionally, the displaced food permanently stains the floor or nearby objects, damaging the looks and value of the floor or objects.

SUMMARY OF THE INVENTION

The object of the present invention is to provide a shield apparatus that minimizes the spillage of food from a high chair tray.

The shield apparatus of the present invention comprises a wall and securing means. The shield has dimensions such that the member partially encompasses a high chair tray's eating surface and prevents the high chair occupant from disposing food over and around the member when the shield is located on the high chair tray. The wall of the shield serves to block disposal of food over the front and sides of the tray. The securing means of the shield couples with the high chair tray to prevent the shield from being dislodged by the high chair occupant, holding the shield firmly to the high chair tray.

The invention also discloses a method of attaching and removing the shield to and from a high chair tray. The shield is oriented vertically, located on the tray, and secured to the tray so that the shield forms a barrier around the tray. The shield is removed from the tray by uncoupling the securing means from the tray and lifting the shield off the tray. The shield may then be cleaned and subsequently reattached to the tray, or folded up and stored away.

BRIEF DESCRIPTION OF THE DRAWINGS

The present invention will be described in greater detail with reference to the accompanying drawings, which illustrate a preferred embodiment of the invention, wherein.

DESCRIPTION OF PREFERRED EMBODIMENT

Figure 1:
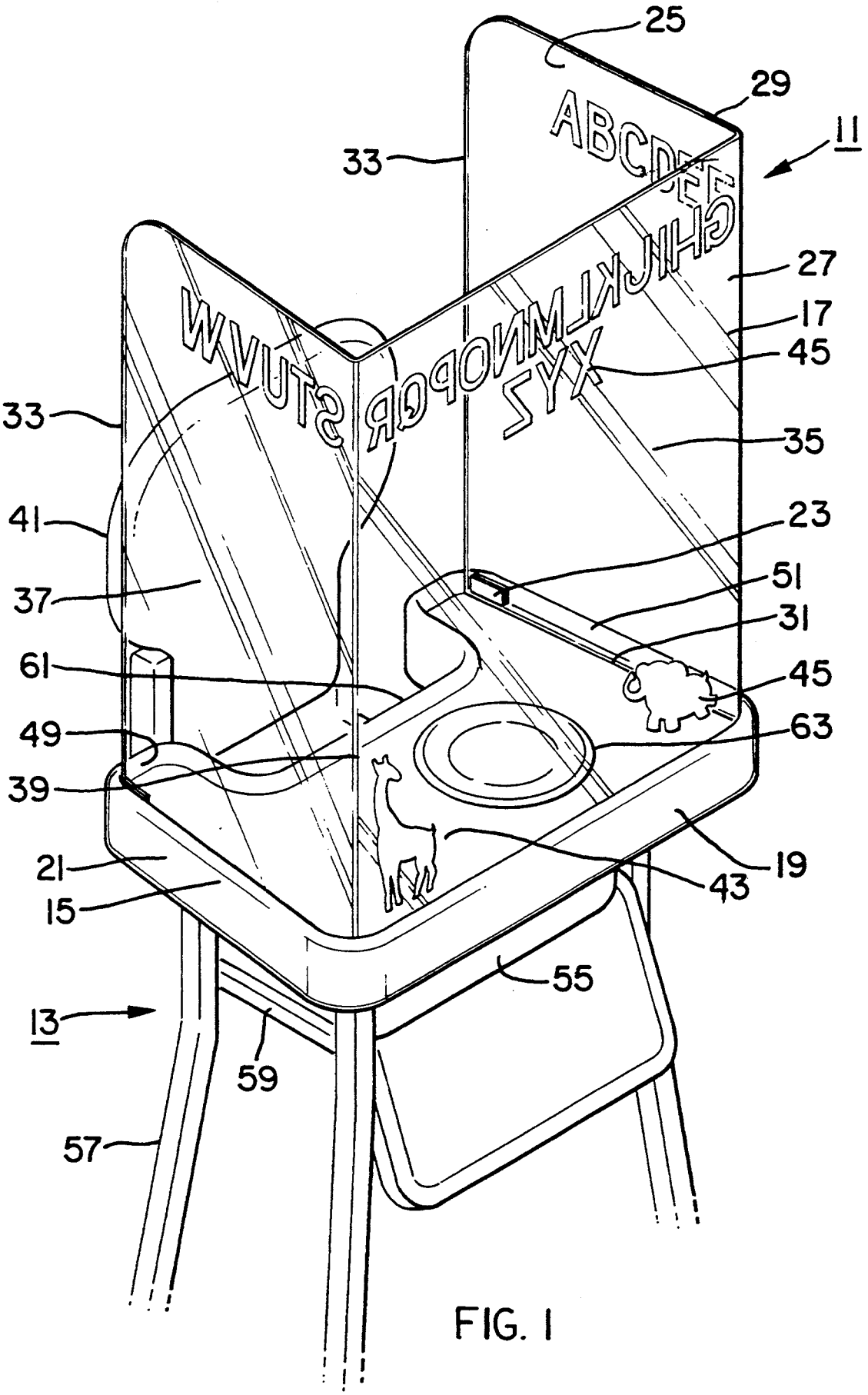
FIG. 1 is an isometric view of the shield of the present invention, in accordance with a preferred embodiment, installed onto a high chair.

As shown in FIG. 1, the shield 11 of the present invention is for use in conjunction with a high chair 13. The high chair 13, which is conventional and commercially available, includes a tray 15 and a seat cushion 55. The tray and seat cushion are supported up off of the ground by a chair frame that includes legs 57 and horizontal beams 59. The legs 57 typically extend upwardly beyond the seat cushion 55 to arm rests. The tray 15 is coupled to the arm rests. The tray has a notch 61 formed therein. The notch 61 allows the tray to extend around the sides of the seated child when the tray is pushed up against the child. The tray 15 has a flat surface 43 that forms an eating area. Plates 63 and other containers of food are placed on the eating area 43. An upwardly extending lip 51 surrounds the eating area 43 in order to contain liquids in the tray. The high chair has a seat back 41. A restraining belt is also typically provided, to restrain the child in a seated position in the chair.

The shield 11 has a wall 17 which blocks food spillage from the front 19 and sides 21 of the high chair tray 15 when the shield 11 is located on the high chair tray 15. The shield 11 also has securing means 23 which removably couples the wall 17 to the high chair tray 15 to keep the shield 11 from being dislodged while in use.

The wall 17 has inner and outer sides 25, 27, a top edge 29, a bottom edge 31, and side edges 33. In the preferred embodiment, the wall 17 is a sheet made up of a front panel 35 and two side panels 37. The front panel 35 and the side panels 37 have fold edges 39, where each side panel 37 is coupled to the front panel 35 and extends transversely from the front panel 35 to a side edge 33. The side panels 37 can be folded along the folds 39 so that the shield may be easily stored.

The vertical and horizontal dimensions of the wall 17 are such that an occupant seated on the high chair seat 55 will have difficulty disposing food over and around the wall 17 when the wall is located on the high chair tray 15. The height of the wall 17 from the bottom edge 31 to the top edge 29 makes it difficult for a high chair occupant to spill food over the top of the front panel 35 and side panels 37 of the wall 17. The wall has front and side dimensions wherein the wall wraps around the eating area located in front of and to the sides of the seated child. The wall 17 has a side dimension which extends from the front panel 35 to the side edges 33, and a front dimension which extends across the front panel 35 from one side panel 37 to the other side panel 37.

Some exemplary dimensions are provided to illustrate the relative size of the shield for a typical high chair. The wall 17 has a height (from top edge 29 to bottom edge 31) of 18 inches. The side dimension of the wall 17, from the respective fold 39 of the front panel 35 to each side edge 33 of the wall 17 is 12 inches. The front dimension of the wall from one fold 39 to the other fold 39 is 16 inches. The wall 17 has a thickness of about 1/16 of an inch. The dimensions of the shield 11 may be varied to fit the sizes and shapes of high chair trays 15 the shield 11 is employed upon.

The front and side dimensions of the wall 17 make it difficult for the high chair occupant to spill food over the front 19 and sides 21 of the high chair tray 15 since the wall 17 surrounds the high chair tray 15 along the front 19 and sides 21. The wall 17, however, takes up only a minimal amount of the eating surface 43 of the tray 15.

The wall 17 is made of a transparent material so that the high chair occupant can see, and be seen, through the wall 17. In addition, the wall should be lightweight, rigid and non-breakable. In the preferred embodiment, the wall is made of a clear acrylic plastic such as plexiglas. A flat sheet of plastic is cut to size and then bent to make the fold edges 39. Decals 45 may be affixed to the inner or outer sides 25, 27 of the wall 17 to amuse and entertain the occupant of the high chair 13.

Figure 2:
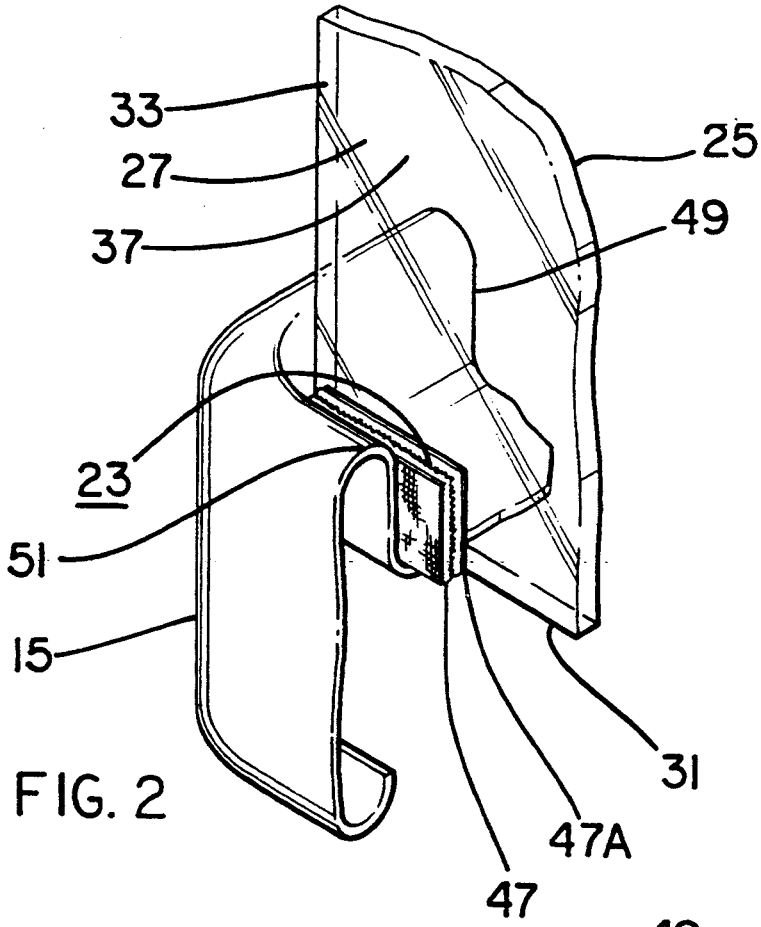
FIG. 2 is an isometric detail view of the securing means which couples the shield to a high chair tray.
Figure 3:
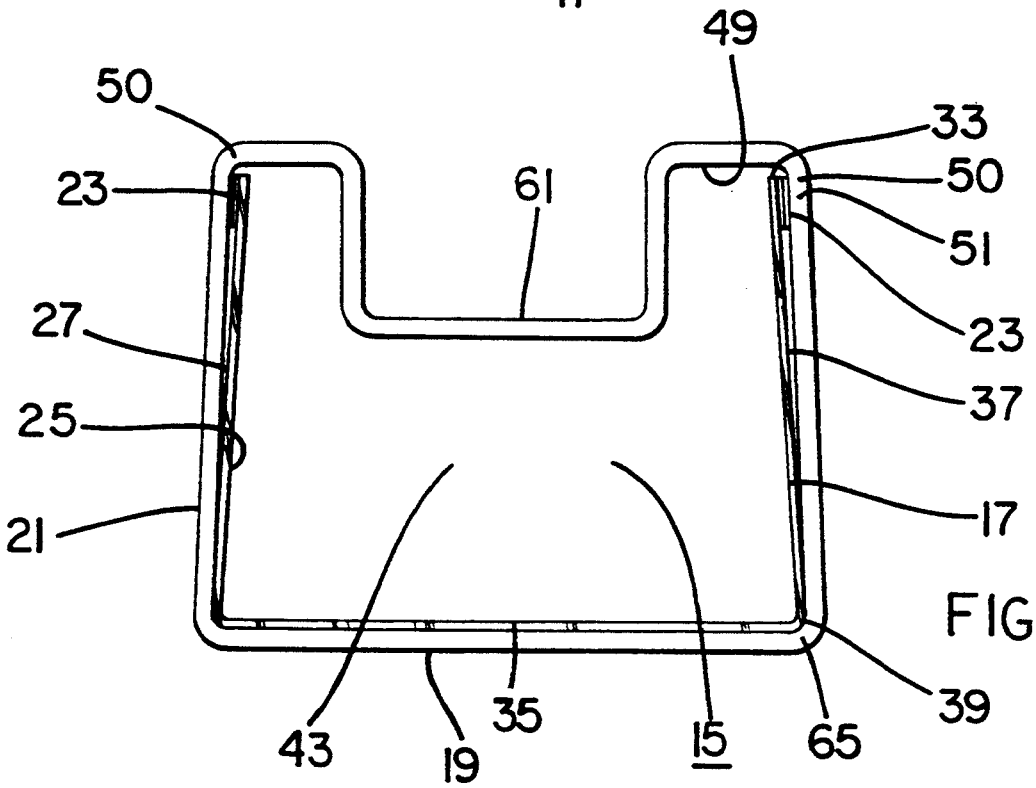
FIG. 3 is a top plan view of the shield resting on, and coupled to, a high chair tray.

The shield 11 also includes two securing means 23 which removably couple the shield 11 to the high chair tray 15 to keep the shield 11 from being dislodged while in use. In the preferred embodiment, the securing means 23 are comprised of hook and loop type fasteners 23 that have a hook portion 47 and a loop portion 47A. Referring to FIGS. 2 and 3, one portion 47A of each fastener 23 is attached to the outer side 27 of a respective side panel 37 near the bottom edge 31 and near the side edge 33 of the wall 17. The other portion 47 of each fastener 23 is attached to outer rear corners 50 of the high chair tray 15. These portions 47 of the fasteners 23 attached to the high chair tray 15 are located on an inner wall 49 of the upwardly extending lip 51 of the high chair tray 15.

In order to install the shield 11 onto a high chair 13 and tray 15, the shield 11 must first be oriented with the wall 17 disposed vertically, where the fastener portions 47 are located near the bottom edge 31 of the wall 17. The shield 11 is then lowered onto the eating surface 43 of the high chair tray 15. The shield 11 is located on the tray 15 so that the wall 17 of the shield 11 is adjacent to the inner wall 49 of the lip 51, and the fastener portions 47A attached to the side panels 37 of the wall 17 align with the fastener portions 47 attached to the inner wall 49 of the lip 51 of the high chair 15. The fastener portions 47, 47A are then coupled together so as to secure the shield 11 to the tray 15. When installed, the bottom edge 31 of the wall bears on the eating surface 43. Also, the bottom portions of the fold edges 39 are snugged into the front corners 65 of the tray lip 51, in order to enhance stability of the wall.

The shield 11 is simple to install onto a high chair tray. Because the shield provides an effective barrier, it is preferred to seat the child in the chair before installing the shield. Alternatively, the shield can be installed onto the tray and the tray-shield arrangement can be installed together on the high chair. Once the shield is installed, food will be contained within the eating area. If the child splatters food, then the splatter will hit the shield and not the floor or surrounding furniture. Because the side edges 33 of the shield extend near the shoulder of the child, it is difficult for the child to throw food around the shield. Also, the child can see and be seen through the shield and hear and be heard from around the shield so that the child does not feel isolated from the family.

Because the shield has side panels 37 that are oriented somewhat perpendicularly to the front panel 35, the shield is inherently stable and not prone to tipping. Furthermore, the shield is securely coupled to the tray by the fasteners 23 and by the abutting position of the bottom edge 31 against the inner wall 49 of the lip 51. Thus, the child can hit the shield with a hand and not dislodge or tip the shield. Likewise, any family member who may accidently hit the tray or shield will not dislodge or tip the shield.

When the child is finished eating, the high chair and shield can be cleaned. Because the shield is elevated by virtue of its location on the tray, a parent need not stoop to the floor during cleanup. All of the food that would normally fall to the floor is on the shield. The shield 11 can be removed from the tray by disengaging the securing means 23 and lifting the shield 11 off the tray 15. The shield 11 may then be cleaned of any foodstuffs which have been disposed thereon. Soap and warm water may be used for cleaning. The shield 11 may then either be reinstalled on the high chair tray 15 or stored away. To store the shield, the side panels 37 are folded in towards the front panel to form a flat object.

The above description of the invention is the preferred embodiment of the invention, however, the invention has other embodiments. In particular, the wall 17 of the shield 11 is not limited to having three panels 35, 37. For example, the wall 17 may be a single sheet of flexible material that conforms to the eating surface 43 of the high chair tray 15. The wall 17 may have two panels, or may have more than three panels as well. In addition, the dimensions and orientation of the wall 17 are variable.

Although the shield has been described as having side edges 33 that terminate at the rear of the tray, the side edges, or at least those portions of the side edges that are located above the lip 51, can be extended rearwardly beyond the lip.

The invention is not limited to hook and loop type securing means. The invention envisions various methods of attaching the shield 11 to the tray 15, whether the tray 15 has an upwardly extending lip 51 or not. For example, snaps could be used to secure the shield to the tray.

The foregoing disclosure and the showings made in the drawings are merely illustrative of the principles of this invention and are not to be interpreted in a limiting sense.

We claim:

1. An apparatus, comprising:

a) a high chair having a seat;

b) a tray having an eating surface, and a perimeter around said eating surface, said tray being coupled to said high chair;

c) a wall having inner and outer sides, a top edge portion, a bottom edge portion, and side edges, said wall being located partially about said eating surface with said top edge portion being located above said tray and said side edges being located near rear portions of said tray, said bottom edge portion being in contact with said tray;

d) securing means for securely coupling said wall to said high chair tray, said securing means being coupled to said wall.

2. The apparatus of claim 1, wherein said securing means removably couples said wall to said high chair tray so that said wall may be easily attached to and detached from said high chair tray.

3. The apparatus of claim 1, wherein said wall is formed of a transparent, rigid, self-supporting material.

4. The apparatus of claim 1, wherein said securing means are hook and loop type fasteners.

5. The apparatus of claim 1, wherein said wall comprises a front panel and side panels, said front panel having front edges, said front edges extending between said top and bottom portions of said wall, said side panels being foldably coupled to said respective front edges so that said side panels are foldable relative to said front panel.

6. The apparatus of claim 1, further comprising decals affixed to said wall for the purpose of entertaining and amusing a child seated in said high chair.

7. The apparatus of claim 1, wherein said wall is formed of a solid, transparent plastic material.

8. A method of reducing food spillage from a high chair, said high chair comprising a seat and a tray that has front and side edges, said method comprising the steps of:

a) providing a rigid, transparent, shield, where said shield has a top, a bottom, and sides;

b) orienting said shield vertically so that said top of said shield is disposed above said bottom of said shield;

c) securing said vertically oriented shield to said front and side edges of said tray such that said shield forms a barrier around said tray that reduces food spillage off of said tray due to the height, length and width of said wall.

9. The method of claim 8, further comprising the steps of:

a) removing said shield from said tray;

b) cleaning said shield of foodstuffs disposed thereon;

c) reorienting said shield vertically so that said top of said shield is disposed above said wall;

d) reinstalling said shield on to said tray by securing said vertically oriented wall to said front and side edges of said tray.

10. The method of claim 8, further comprising the steps of:

a) removing said shield from said tray;

b) folding said shield for storage.

* * * * *